United States Patent [19]

Osaki

[11] Patent Number: 4,625,375

[45] Date of Patent: Dec. 2, 1986

[54] APPARATUS FOR AUTOMATICALLY PROCESSING A SLIDE FASTENER CHAIN

[75] Inventor: Tatsuo Osaki, Uozu, Japan

[73] Assignee: Yoshida Kogyo K.K., Tokyo, Japan

[21] Appl. No.: 570,269

[22] Filed: Jan. 12, 1984

[30] Foreign Application Priority Data

Jan. 25, 1983 [JP] Japan ..... 58-10329

[51] Int. Cl.[4] ..... A41H 37/06; B21D 53/50; B21F 45/18; B29D 5/00

[52] U.S. Cl. ..... 29/33.2; 29/34 A; 29/408; 29/766; 29/770

[58] Field of Search ..... 29/33.2, 34 A, 408–410, 29/766–770

[56] References Cited

U.S. PATENT DOCUMENTS 3,844,017 10/1974 Fisher et al. ..... 29/33.2
4,443,924 4/1984 Osaki ..... 29/770 X

FOREIGN PATENT DOCUMENTS 56-3003 1/1981 Japan .
58-4501 1/1983 Japan ..... 29/408

*Primary Examiner*—Gil Weidenfeld
*Assistant Examiner*—Steven C. Bishop
*Attorney, Agent, or Firm*—Hill, Van Santen, Steadman & Simpson

[57] ABSTRACT

An apparatus, for automatically processing a slide fastener chain to which a succession of fly strips is attached, comprises an intermittently operative feed unit for feeding the fastener chain along a longitudinal path, a first cutting unit disposed upstream of the feed unit for forming element-free gaps in the fastener chain near or at ends of successive fly strips, and a second cutting unit disposed downstream of the feed unit for severing the fastener chain at such element-free portions. The apparatus also includes a measuring unit disposed upstream of the first cutting unit for measuring the amount of the fastener chain having been fed by the feed unit, and a detector disposed between the first cutting unit and the measuring unit for detecting ends of successive fly strips. The measuring unit and the detector are electrically connected to a processing circuit which produces output signals to control the intermittent operation of the feed unit in timed relation with the operations of the first and second cutting units.

1 Claim, 12 Drawing Figures

APPARATUS FOR AUTOMATICALLY PROCESSING A SLIDE FASTENER CHAIN

BACKGROUND OF THE INVENTION

1. Field of the Invention

The present invention relates to the manufacture of trouser closures for fly openings, and more particularly to an apparatus for automatically processing a slide fastener chain to which a succession of fly strips is attached.

2. Prior Art

In the manufacture of trouser closures for fly openings from a continuous slide fastener chain to which a succession of fly strips is attached, it is customary to form element-free gaps in the fastener chain near or at ends of the successive fly strips and also to sever the fastener chain at such element-free portions. Japanese Patent Laid-Open Publication (Kokai) 56-3003, published on Jan. 13, 1981, discloses an apparatus which includes a vertically movable combined cutter having a cross-shaped cutting edge. The combined cutter, when lowered, breaks off several fastener elements to form an element-free gap in the fastener chain and, at the same time, severs the fastener chain at such element-free portion.

However, in this prior apparatus, the feeding and discharging of the fastener chain is carried out manually, which is laborious and time-consuming. In a hypothetical arrangement having a pair of intermittently operative feed rollers for the fastener chain disposed upstream of the combined cutter to automate the prior apparatus, jamming of the fastener chain would tend to occur at a cutting station where a guide for a pair of interengaged fastener element rows is located. Otherwise, if the feed rollers were disposed downstream of the combined cutter, proper intermittent feeding of the fastener chain at the upstream side of the combined cutter could not be achieved. Also, using a gripping mechanism to feed the fastener chain, which mechanism is relatively complex in structure, makes the apparatus oversized and hence expensive.

SUMMARY OF THE INVENTION

According to the present invention, an apparatus, for automatically processing a slide fastener chain to which a succession of fly strips is attached, comprises an intermittently operative feed unit for feeding the fastener chain along a longitudinal path, a first cutting unit disposed upstream of the feed unit for forming element-free gaps in the fastener chain near or at ends of successive fly strips, and a second cutting unit disposed downstream of the feed unit for severing the fastener chain at such element-free portions. The apparatus also includes a measuring unit disposed upstream of the first cutting unit for measuring the amount of the fastener chain fed by the feed unit, and a detector disposed between the first cutting unit and the measuring unit for detecting ends of successive fly strips. The measuring unit and the detector are electrically connected to a processing circuit which produces output signals to control the intermittent operation of the feed unit in timed relation with the operations of the first and second cutting units.

It is therefore an object of the invention to provide an automatic apparatus for forming element-free gaps in a slide fastener chain, to which a succession of fly strips is attached, and for severing the fastener chain at such element-free portions in timed relation with the formation of the element-free gaps, without jamming of the fastener chain.

Another object of the invention is to provide an automatic, slide-fastener-chain processing apparatus which is simple in construction and hence inexpensive.

Many other advantages, features and additional objects of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
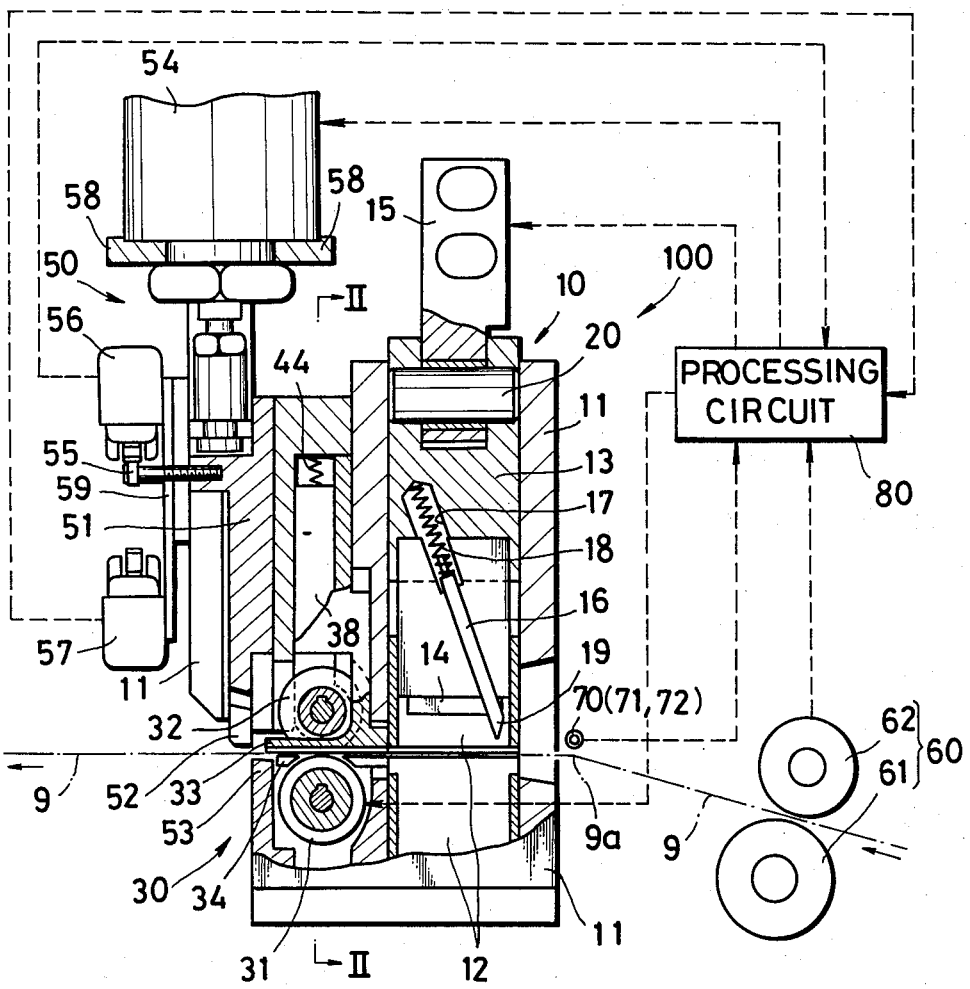
FIG. 1 is a fragmentary front elevational view, with parts broken away, of an apparatus embodying the present invention.
Figure 2:
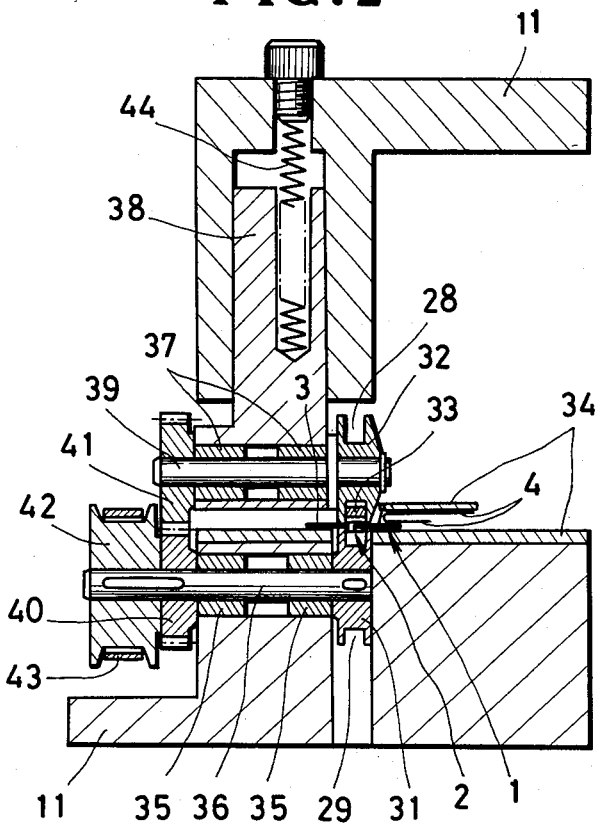
FIG. 2 is a cross-sectional view taken along line II—II of FIG. 1.
Figure 3:
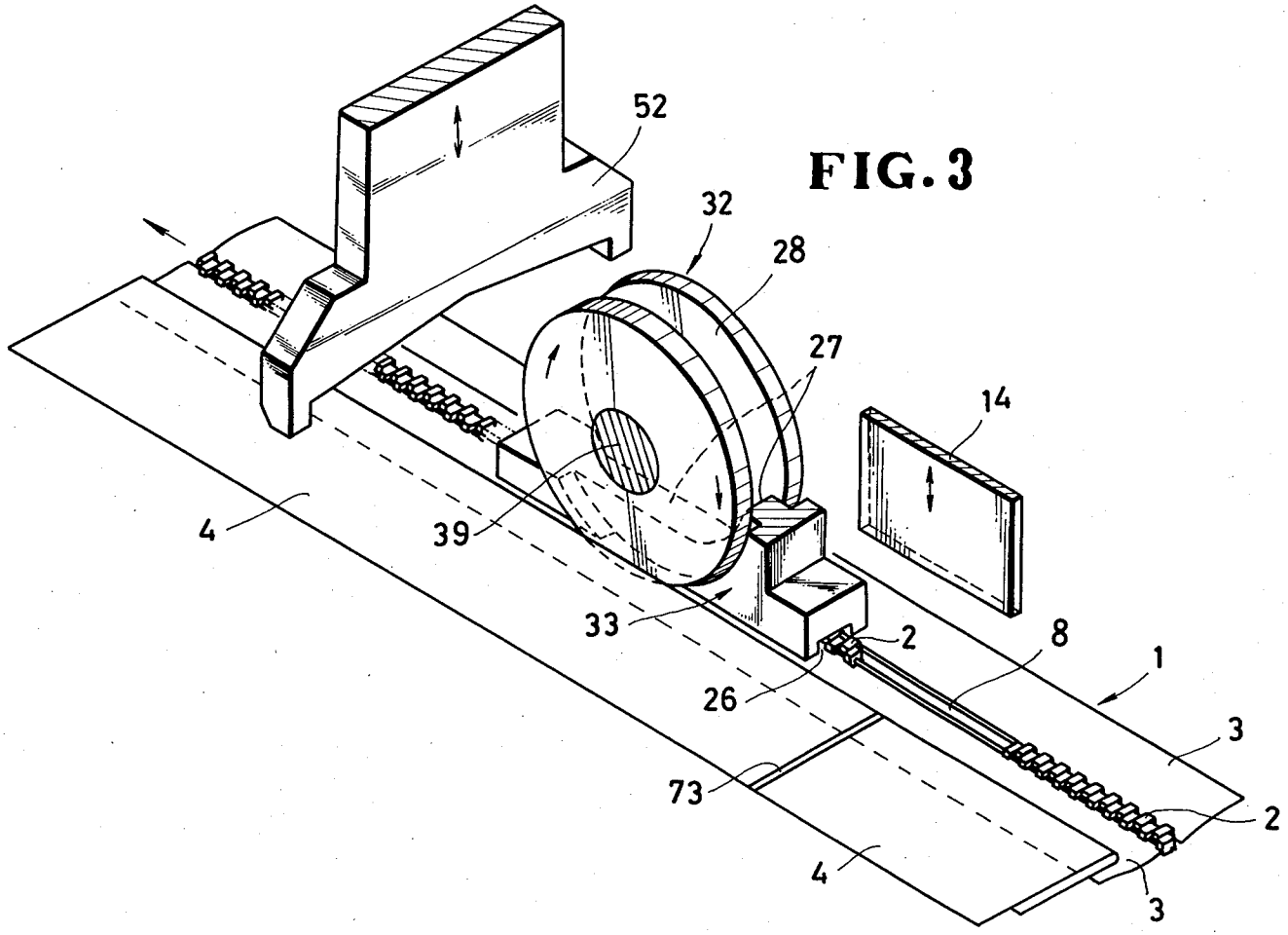
FIG. 3 is an enlarged, fragmentary perspective view of the primary parts of the apparatus.
Figure 4:
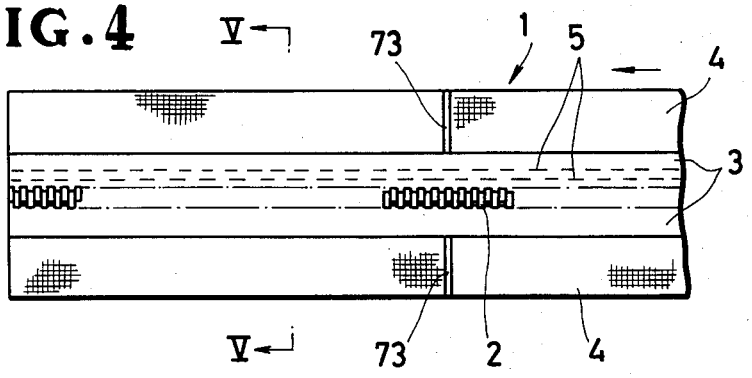
FIG. 4 is a fragmentary bottom view of a slide fastener chain to which a succession of fly strips is attached.
Figure 5:
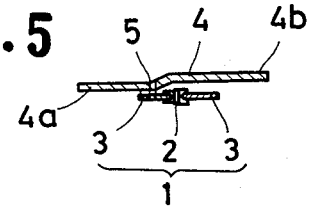
FIG. 5 is a transverse cross-sectional view taken along line V—V of FIG. 4.

FIGS. 1 to 3 show an apparatus 100 for automatically manufacturing slide fasteners for trouser closures for fly openings, from a slide fastener chain 1. As shown in FIGS. 3 to 5, the fastener chain 1 includes a succession of fly strips 4 connected end to end in substantially abutting relation by a pair of continuous stringer tapes 3, 3 supporting on their inner longitudinal edges a pair of interengaged rows of fastener elements 2. The successive fly strips 4 are attached to one of the stringer tapes 3 by sewn stitches 5, dividing each fly strip 4 into a first and a second flap **4*a*, 4*b*. As better shown in FIG. 5, the first flap 4*a* overlaps only one tape 3 in close relation therewith, while the second flap 4*b* overlaps not only the other tape 3 but also the pair of interengaged fastener element rows 2 with a relatively small gap between the second flap 4*b* and the other tape 3**.

The apparatus 100 generally comprises a first cutting unit 10 for breaking off several fastener elements 2 of the fastener chain 1 to form an element-free gap 8 (FIG. 3) in a pair of interengaged fastener element rows 2, a feed unit 30 disposed downstream of the first cutting unit 10 for feeding the fastener chain 1 along a longitudinal doglegged path 9 (hereinafter referred to as "chain path"), a second cutting unit 50 disposed downstream of the feed unit 30 for severing the fastener chain 1 transversely across such element-free portion, a measuring unit 60 disposed upstream of the first cutting unit 10 for measuring the length of the fastener chain 1 having been fed by the feed unit 30, and a detector 70 disposed between the measuring unit 60 and the first cutting unit 10 for detecting ends of the successive fly strips 4.

The first cutting unit 10 (FIG. 1) includes a pair of (upper and lower) cutter guides 12, 12 fixed to a frame 11 in confronting relation to one another with respect to the chain path 9, a first ram 13 disposed above the upper cutter guide 12 and vertically slidably supported on the frame 11, and an element cutter 14 mounted on a lower end of the first ram 13.

The first ram 13 is connected at its upper end to a vertically slidable press ram (not shown) via a connecting rod 15 and has at its lower end a fastener-chain positioning bar 16, the connecting rod 15 being connected to the ram 13 by means of a pin 20. The positioning bar 16 is inserted at its upper end into a blind hole 17 in the first ram 13 and is inclined downwardly to the upstream side of the apparatus 100. A compression spring 18 is mounted in the blind hole 17 of the first ram 13, acting between the latter and the positioning bar 16 to normally urge a pawl 19 of the positioning bar 16 to project downwardly beyond a cutting edge of the element cutter 14.

As shown in FIG. 3, the cutting edge of the element cutter 14 has a rectangular face vertically aligned with the center line of the chain path 9, i.e. the center line of the pair of interengaged fastener element rows 2 of the fastener chain 1. The feed unit 30 includes a pair of (lower and upper) feed rollers 31, 32, a fastener-chain guide 33 extending alongside the chain path 9 at the upperside thereof, and a pair of fly-strip guides 34, 34 (FIGS. 1 and 2) disposed opposite to each other with respect to the chain path 9.

The lower feed roller 31, as shown in FIG. 2, has an annular groove 29 extending in and along a peripheral surface of the roller 31, and is mounted on one end (right end in FIG. 2) of a first shaft 36 rotatably supported by the frame 11 via a pair of bearings 35, 35. Likewise, the upper feed roller 32 has an annular groove 28 extending in and along a peripheral surface of the roller 32, and is mounted on one end (right end in FIG. 2) of a second shaft 39 rotatably supported by a support 38 via a pair of bearings 37, 37. A first gear 40 is mounted on the first shaft 36 at the other end (left end in FIG. 2) thereof and meshes with a second gear 41 mounted on the other end of the second shaft 39. Mounted at said other end of the first shaft 36 is a pulley 42 which is operatively connected with a drive source (not shown) such as a motor by means of an endless belt 43 wound around the pulley 42.

The support 38 is vertically movably supported by the frame 11 and is normally urged downwardly by a compression spring 44 (FIGS. 1 and 2), causing the upper roller 32 and the second gear 41 to be pressed against the lower roller 31 and the first gear 40, respectively.

A fastener-element guide 33 is disposed adjacent to the upper feed roller 32. As better shown in FIG. 3, the fastener-element guide 33 has at its upper side a longitudinal tongue 27 and at its lower side a longitudinal guide groove 26. The tongue 27 of the fastener-element guide 33 is received in the groove 28 of the upper feed roller 32, and the pair of interengaged fastener element rows 2 of the fastener chain 1, as the latter is fed, is received in the guide groove 26 of the guide 33, thus preventing lateral displacement of the fastener chain 1.

The second cutting unit 50, as shown in FIG. 1, includes a second ram 51 vertically movably supported by the frame 11, a fastener-chain cutter 52 mounted on a lower end of the second ram 51, a cutter die 53 fixed to the frame 11 in confronting relation to the cutter 52 with respect to the chain path 9, and a fluid-pressurized cylinder 54 operatively connected to the second ram 51 for vertically moving the second ram 51 and thus the cutter 52. The cylinder 54 is fixed to the frame 11 by a bracket 58. A threaded screw 55 is carried by the second ram 51, and a pair of (upper and lower) limit switches 56, 57 is fixed to the frame 11 by a bracket 59; each limit switch 56, 57 is actuated by the screw 55 in response to the vertical movement of the second ram 51, thus detecting the upper or lower end of the stroke of the second ram 51. Each limit switch 56, 57, when actuated, produces an electrical signal to energize or de-energize the cylinder 54, thus limiting upward and downward movement of the fastener-chain cutter 52.

The measuring unit 60 (FIG. 1) includes a pair of idler rollers 61, 62 which corotate as the fastener chain 1 is fed by the feed rollers 31, 32, and the unit 60 produces a number of electrical signals, depending on the number of revolutions of one of the idler rollers 61, 62, i.e. the amount of the fastener chain 1 having been fed. The electrical signals are applied to a known processing circuit 80 (FIG. 1) which then produces output signals to control the feeding of the fastener chain 1 in timed relation with the intermittent operation of the first and second cutting units 10, 50 in a manner described below.

As shown in FIG. 1, the detector 70 is disposed adjacent to the turning point **9*a* of the chain path 9 for sensing the presence of a triangular space 73 (FIG. 9) between an adjacent pair of the second flaps 4*b* having been deflected in a manner described below and also described in the U.S. Pat. No. 4,443,924, issued Apr. 24, 1984. The detector 70 includes a light source 71 positioned on one side of the path of the second flaps 4*b*, and a photoelectric transducer element 72 positioned on the other side of the path of the second flaps 4*b* for receiving the light passed trough the triangular space 73 when confronting ends of an adjacent pair of the fly strips 4 arrive at the turning point 9*a*. The photoelectric transducer element 72 produces a pulse signal every time each triangular space 73 is sensed by the detector 70. Thus the pulse signal indicates that the confronting ends of an adjacent pair of the second flaps 4*b*, i.e. a trailing end of the corresponding preceding fly strip 4 and a leading end of the corresponding succeeding fly strip 4, have arrived at the turning point 9*a***.

Figure 6:
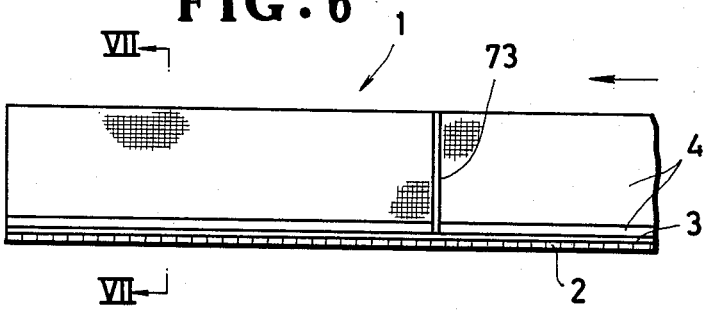
FIG. 6 is a fragmentary side elevational view of the slide fastener chain, showing second flaps of the fly strips having been deflected.
Figure 7:
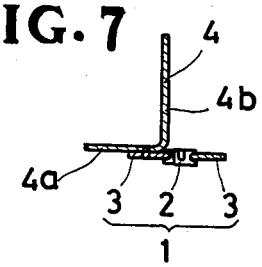
FIG. 7 is a transverse cross-sectional view taken along line VII—VII of FIG. 6.

In operation, as the feed unit 30 is energized, the fastener chain 1 is fed along the chain path 9 through the measuring unit 60, the turning point **9*a*, the first cutting unit 10, the feed unit 30, and the second cutting unit 50 in the order mentioned. Initially, the succession of fly strips 4, with the first flaps 4*a* overlapping the tape 3 and with the second flaps 4*b* overlapping both the other tape 3 and the pair of interengaged fastener element rows 2 (FIGS. 4 and 5), are fed through the measuring unit 60 toward the turning point 9*a*. By the time each fly strip 4 arrives at the turning point 9*a*, the corresponding second flap 4*b* is deflected or moved aside progressively by a known deflector (not shown) until the second flap 4*b* lies at a right angle with respect to the general plane of the fastener chain 1 as shown in FIGS. 6 and 7**.

Figure 8:
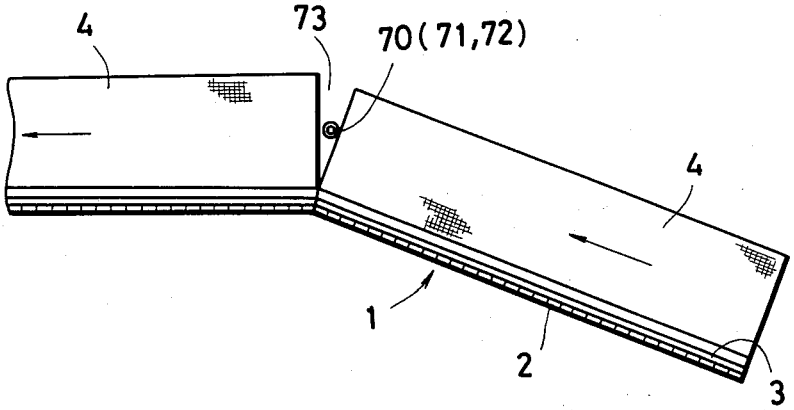
FIG. 8 is a fragmentary side elevational view of the slide fastener chain, showing an adjacent pair of the second flaps with a triangular space provided between their confronting ends.
Figure 9:
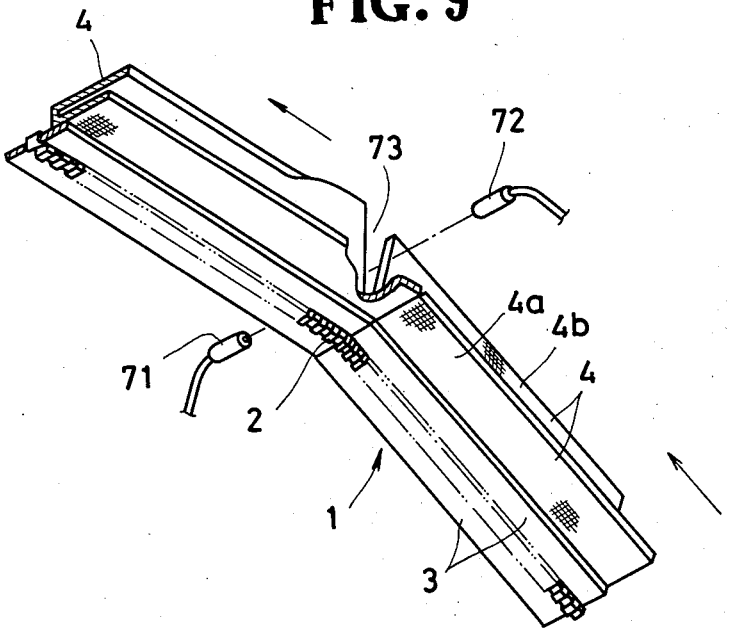
FIG. 9 is a fragmentary perspective view corresponding to FIG. 8.

The fly strip 4, with the deflected second flap 4*b*, is then moved to the turning point 9*a* where the direction of movement of the successive fly strips 4 is shifted, as shown in FIGS. 8 and 9. A relatively large triangular space 73 is temporarily provided between the confronting ends of an adjacent pair of the successive second flaps 4*b*, 4*b* when the same confronting ends arrive at the turning point 9*a*. This relatively large inter-flap space 73 allows the light from the light source 71 to pass through the space 73 to reach the photoelectric transducer element 72. The photoelectric transducer element 72 produces a signal pulse, which indicates that a trailing end of the preceding fly strip 4 and a leading end of the succeeding fly strip 4 have arrived at the turning point 9*a*. Upon receipt of the signal pulse from the photoelectric transducer element 72, the processing circuit 80 starts to count the electrical signals from the measuring unit 60. When the number of the counted electrical signals reach a first predetermined value corresponding to the distance between the first cutting unit 10 and the turning point 9*a*, the processing circuit 80 produces a first output signal, whereupon a drive (not shown) for the feed roller 31 is de-energized to terminate the feeding of the fastener chain 1 and, at the same time, a press ram (not shown) for the first cutting unit 10 is energized. At that time the confronting ends of an adjacent pair of the successive fly strips 4 are in vertical registration with the element cutter 14.

As the successive fly strips 4 travel from the turning point 9*a* to the first cutting unit 10, the second flap 4*b* of each fly strip 4 is progressively folded over the corresponding first flap 4*a*.

Figure 10A:
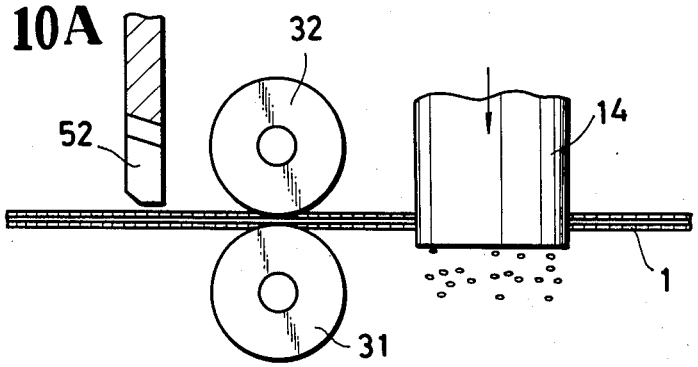
FIGS. 10A, 10B and 10C are fragmentary front elevational views of the primary parts of the apparatus, illustrating the manner in which a slide fastener, with a fly strip attached thereto, is progressively manufactured.

The ram 13, upon energization of the non-illustrated press ram, is moved downwardly, together with the element cutter 14 and the fastener-chain positioning bar 16. As a result, the pawl 19 of the positioning bar 16 projects into an adjacent pair of fastener element rows 2 to retain the fastener chain 1 and, at the same time, the element cutter 14 projects through the pair of interengaged fastener-element rows 2 to break off several fastener elements 2 (FIG. 10A). Thus an element-free gap 8 has been provided in the pair of interengaged fastener element rows 2.

Figure 10B:
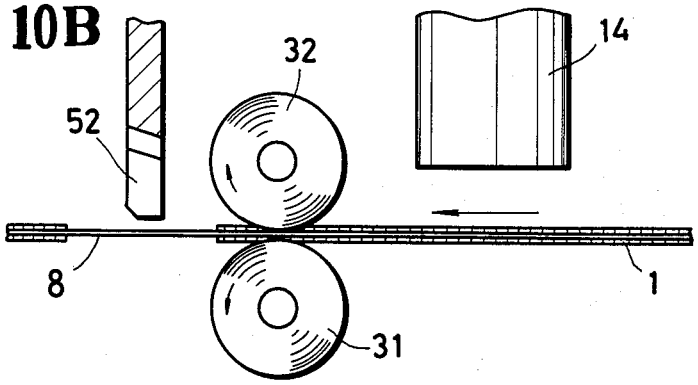

Then, the ram 13 is moved upwardly, together with the element cutter 14 and the positioning bar 16. A limit switch (not shown) produces an electrical signal when the ram 13 returns to its raised position (FIG. 10B). Upon receipt of the electrical signal from the non-illustrated limit switch, the non-illustrated drive for the feed unit 30 is energized, and the feed rollers 31, 32 restart to rotate to feed the fastener chain 1.

Figure 10C:
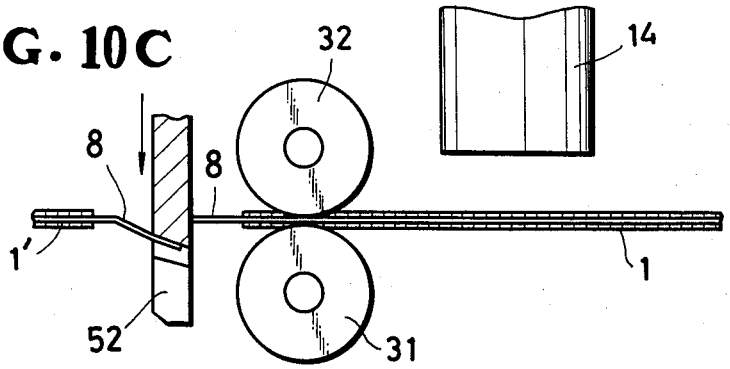

When the next signal pulse from the detector 70 is issued, i.e. when the number of the counted electrical signals from the measuring unit 60 reaches a second predetermined value corresponding to the distance between the second cutting unit 50 and the turning point 9*a*, the processing circuit 80 produces a second output signal to de-energize the feed unit 30. At that time the element-free gap 8 of the fastener chain 1 is in vertical registration with the fastener-chain cutter 52 (FIG. 10B). The distance between the second cutting unit 50 and the turning point 9*a* equals to the length of the individual fly strip 4. Concurrently with this de-energization of the feed unit 30 and upon receipt of the second output signal from the processing circuit 80, the second cutting unit 50 is energized to cause the fastener-chain cutter 52 to descend to sever the fastener chain 1 transversely across the element-free portion 8 (FIG. 10C). Thus a slide fastener 1′ (FIG. 10C) for a "fly-opening" closure has been manufactured.

When the fastener-chain cutter 52 reaches the lowered position, the screw 55 (FIG. 1) carried by the second ram 51 hits an actuator of the lower limit switch 57 which then produces an electrical signal. Upon receipt of this electrical signal, the processing circuit 80 produces an output signal to reverse the cylinder 54, causing the fastener-chain cutter 52 to ascend. When the fastener-chain cutter 52 reaches the raised position, the screw 55 hits an actuator of the upper limit switch 56 which then produces an electrical signal. Upon receipt of this electrical signal, the processing unit 80 produces, an output signal to de-energize the cylinder 54. Finally, the slide fastener 1′ is discharged to a tray or a pheripheral apparatus (both not shown) by a non-illustrated suitable feed means.

According to the appratus 100, since the element cutter 14 and the fastener-chain cutter 52 are disposed upstream and downstream, respectively, of the fastener-chain feed rollers 31, 32, it is possible to manufacture a number of slide fasteners for fly-opening closures successively without jamming.

Another advantage of the apparatus 100 is that although the element cutter 14 and the fastener-chain cutter 52 are disposed remotely from one another, it is possible to automate both the formation of element-free gaps 8 and the severing of the fastener-chain 1, partly because the measuring rollers 61, 62 and the fly-strip detector 70 are disposed upstream of the element cutter 14 so that the fly-strip detector 70 is disposed between the element cutter 14 and the measuring rollers 61, 62 and partly because the detector 70 and the measuring rollers 31, 32 produce electrical signals which are sent to a processing circuit to control the operation of the two cutters 14, 52 independently in timed relation to one another. With this arrangement, both the formation of element-free gaps 8 and the severing of the fastener chain 1 can take place accurately near or at ends of the successive fly strips 4, irrespective of the length of the fly strips 4.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for automatically processing a slide fastener chain to which a sucession of fly strips is attached, comprising:

(a) an intermittently operative feed unit for feeding the fastener chain longitudinally along a path;

(b) a first cutting unit, disposed on the path upstream of said feed unit, for forming an element-free portion in the fastener chain while said feed unit is inoperative;

(c) a second cutting unit, disposed on the path downstream of said feed unit, for severing the fastener chain transversely across the element-free portion while said feed unit is inoperative;

(d) a measuring unit, independent of said drive unit and disposed on the path upstream of said first cutting unit, for producing a number of electrical signals, depending on the amount of the fastener chain having been fed through said measuring unit, said measuring unit comprising a pair of idler rollers which are corotatable as the fastener chain is fed by said feed unit and which produces a number of the electrical signals depending on the number of revolutions of one of the idler rollers;

(e) a detector, disposed on the path between said first cutting unit and said measuring unit, for producing a signal pulse each time confronting ends of each adjacent pair of the successive fly strips arrive at said detector, said detector comprising a light source positioned on one side of the path of the fly strips, and a photoelectric transducer element positioned on the other side of the path of the fly strips for receiving the light passed through a space between confronting ends of an adjacent pair of the successive fly strips; and (f) a processing circuit having outputs for electrically controlling said cutting units separately, and having inputs electrically connected to said detector and said measuring unit for, upon receipt of one signal pulse from said detector, counting the electrical signals having been issued from said measuring unit, and for producing a first output signal, when the number of the counted electrical signals reaches a first predetermined value corresponding to the distance between said first cutting unit and said detector, to de-energize said feed unit and, at the same time, to energize said first cutting unit, and for thereafter counting additional electrical signals from said measuring unit, and for producing a second output signal, when the number of the counted electrical signals reaches a second predetermined value corresponding to the distance between said cutting units, to again de-energize said feed unit and to energize said second cutting unit.

* * * * *